US009297187B2

(12) United States Patent
Glover

(10) Patent No.: US 9,297,187 B2
(45) Date of Patent: Mar. 29, 2016

(54) GATE LATCH

(71) Applicant: Jerry Dean Glover, La Selva Beach, CA (US)

(72) Inventor: Jerry Dean Glover, La Selva Beach, CA (US)

( * ) Notice: Subject to any disclaimer, the term of this patent is extended or adjusted under 35 U.S.C. 154(b) by 89 days.

(21) Appl. No.: 14/319,524

(22) Filed: Jun. 30, 2014

(65) Prior Publication Data

US 2014/0353987 A1 Dec. 4, 2014

Related U.S. Application Data

(62) Division of application No. 13/529,649, filed on Jun. 21, 2012, now Pat. No. 8,764,076.

(51) Int. Cl.

| | |
|---|---|
| ***E05C 3/16*** | (2006.01) |
| ***E05B 53/00*** | (2006.01) |
| ***E05B 65/00*** | (2006.01) |
| ***E05C 3/30*** | (2006.01) |

(52) U.S. Cl.

CPC ..... *E05C 3/16* (2013.01); *E05B 53/003* (2013.01); *E05B 65/0007* (2013.01); *E05C 3/30* (2013.01); *Y10T 292/1057* (2015.04); *Y10T 292/57* (2015.04); *Y10T 292/702* (2015.04)

(58) Field of Classification Search

CPC . E05B 53/003; E05B 53/005; E05B 65/0007; E05C 3/16; E05C 3/30; E05C 3/004; E05C 3/006; E05C 3/12; E05C 3/162; E05C 3/167; E05C 3/22; E05C 3/24; E05C 3/26; E05C 3/40

See application file for complete search history.

(56) References Cited

U.S. PATENT DOCUMENTS 1,244,910 A * 10/1917 Smith ..... E05B 63/244 292/255
1,317,888 A * 10/1919 Nardi ..... E05B 85/24 292/223
1,591,383 A * 7/1926 Herzing ..... E05C 3/30 292/127
1,618,617 A * 2/1927 Whitney ..... E05C 17/64 292/194
1,703,556 A * 2/1929 Stewart ..... E05C 3/30 292/127
1,822,327 A * 9/1931 Ullom ..... E05C 5/04 292/95
2,572,730 A * 10/1951 Jones ..... B60K 15/05 220/86.2
2,598,670 A * 6/1952 Bentley ..... B60K 15/05 220/262
2,661,949 A * 12/1953 Bauer ..... B21B 39/002 271/224
3,282,617 A * 11/1966 Wason ..... E05B 65/0007 292/171
3,498,658 A * 3/1970 Steenstra ..... A01K 1/0017 292/167
3,838,877 A * 10/1974 Hanson ..... E05B 65/0021 292/134

(Continued)

*Primary Examiner* — Alyson M Merlino
(74) *Attorney, Agent, or Firm* — Donald R. Boys; Central Coast Patent Agency, Inc.

(57) ABSTRACT

A gate latch release mechanism has a cylindrical tubular guide having a first length, a mechanism to firmly fasten the tubular guide in a hole through a gate member, a compression spring having a length less than the first length of the tubular guide, the compression spring positioned within the tubular guide and having a first end bearing on a cap at a first end of the tubular guide, a flexible line of a length substantially longer than the tubular guide, the line passing through the compression spring and the tubular guide, and having a handle on one end and a coupling interface on an opposite end, and an element securely fastened to the line within the tubular guide, with the element bearing on a second end of the compression spring within the tubular guide.

7 Claims, 5 Drawing Sheets

(56) References Cited

U.S. PATENT DOCUMENTS 4,217,790 A * 8/1980 Lindblom ..... G05G 25/00 403/109.7
5,054,826 A * 10/1991 Dow ..... E05B 83/16 292/125
5,129,691 A * 7/1992 McFarlen ..... E05C 3/30 292/214
5,358,292 A * 10/1994 Van Wiebe ..... E05B 53/003 292/125
5,498,041 A * 3/1996 Bezzerides ..... E05B 15/022 292/225
6,170,892 B1 * 1/2001 Lantiegne ..... E05B 65/0007 292/235
7,513,542 B2 * 4/2009 Schumm ..... E05C 17/446 292/163
8,764,076 B2 * 7/2014 Glover ..... E05C 3/30 292/225
2011/0254289 A1 * 10/2011 Calamia, III ..... E05B 53/003 292/336.3
2013/0249221 A1 * 9/2013 Arssinous ..... E05C 1/12 292/173

* cited by examiner

GATE LATCH

CROSS-REFERENCE TO RELATED DOCUMENTS

The present patent application is a divisional application claiming priority to application Ser. No. 13/529,649 filed on Jun. 21, 2012, and the disclosure of the parent application is incorporated in its entirety at least by reference.

BACKGROUND OF THE INVENTION

1. Field of the Invention

The present invention is in the field of fencing hardware including gate latches and pertains particularly to methods and apparatus for latching a gate.

2. Discussion of the State of the Art

In the art of fence construction, gate-latching apparatus are used to affect latching between a swing gate and a gatepost. The most common latches are vertical latches that, with the aid gravity and a passive bar grabbing design function to latch gates to prevent entrance to or egress from a fenced area.

Many vertical latch assemblies include a flat mounting plate and latch housing with a pivotally mounted latching plate disposed within the latch housing. Gravity keeps the latch plate in the closed position. A rounded front face on the latch plate allows a latch bar to be inserted into the latching position of the assembly, such action lifting the latch plate just enough to accept the bar. Gravity then urges the latch plate down over the latch bar providing a latched gate.

A challenge with these latches is that there are no operational components for opening and closing the latch. A user swings the gate closed to affect latching and manually lifts up on the latch to release the gate. This is not practical if the gatepost and gate are very tall because the user generally has to reach over the top of the gate to reach the latch assembly in order to unlatch the gate.

In some cases, a hole is drilled through the gatepost and a wooden handle and rope or string is used to connect to the latch assembly through the gatepost to the handle that can be used to pull the latch plate upward, thus releasing the gate. A problem with this approach is that a wooden handle hanging from a string is not aesthetic. Likewise, the latch plate may kink, become slightly rusted, etc. which may prevent gravity from re-closing the latch plate when the string or rope handle is released. Moreover, the rope or string connecting the latch plate to the handle can be easily compromised by wear and tear, rot, or other compromising condition rendering the method less effective at opening and closing the gate.

Therefore, what is clearly needed is a vertical gate latch that solves the above limitations.

SUMMARY OF THE INVENTION

The problem stated above is that consistency of successful operation is desirable for a vertical gate pull latch, but many of the conventional means for operating a vertical pull latch, such as string or rope applicators do not provide consistent operation. The inventors therefore considered functional components of a vertical gate pull latch, looking for elements that exhibit interoperability that could potentially be harnessed to provide consistent successful operation but in a manner that would not create uncertainty in operational integrity.

The present inventor realized in an inventive moment that if during the operation the latch plate could be caused to close correctly against a mild spring pressure significant improvement in consistent operation might result. The inventor therefore constructed a unique gate latch for installation on wooden or metal gateposts that allowed a user to unlatch the gate by pulling the vertical latch up against a mild spring tension that also worked to urge the latch into the closed position when the handle is released. A significant improvement in operational consistency results, with no impediment to motion or complexity of assembly created.

Accordingly, in an embodiment of the present invention, a gate latch is provided and includes a vertical latch assembly including a latch housing and a latch plate disposed centrally therein, the latch plate pivotally mounted to the latch housing by a pin, the latch assembly capable of passively receiving and locking a latch bar mounted to a gate, a latch operating assembly including a cylindrical body having a first end positioned in proximity to the latch assembly, and a second end, the cylindrical body including male threads at least on both ends to accept a first flange nut having matching female threads at the first end, and a second flange nut having matching female threads at the second end, a resilient linear member disposed linearly through the cylindrical body, the linear member fastened to a seat on the latch plate and fastened to a handle at the opposite end, and at least one spring disposed over the linear member, the spring retained in relaxed state within the cylindrical body by a first clamp and first metal washer strategically applied to the linear member at one end of the spring and by a second metal washer seated within the cylindrical body at the opposite end of the spring.

In one embodiment, the linear member is a plastic zip tie that connects to a zip tie receptacle fastened to the latch plate by a pin. In one embodiment, the vertical latch assembly mounts to the face of a gatepost and wherein the latch operating assembly is secured in a through hole drilled through the gatepost above the mounted latch assembly. In one embodiment, the linear member is a braided wire having a first fastening utility at one end for fastening the wire to the latch plate and a second fastening utility disposed at or near the opposite end for fastening the wire to the handle. In this embodiment, the second fastening utility is a second clamp clamped over the wire a strategic distance from the latch plate and fastened to the handle.

In an embodiment where the linear member is a plastic zip tie, the zip tie is inserted through a central opening in the handle and wherein the zip tie head seats in a recess provided on the face of the handle. In an embodiment where the linear member is a wire, the wire is inserted through a central opening in the handle and wherein the clamp seats in a recess provided on the face of the handle.

In one embodiment, the gate latch further includes a first rubber washer disposed between the first flange nut and the face of the gatepost, a second rubber washer disposed between the second flange nut and the opposite face of the gatepost, and a third rubber washer disposed between the second flange nut and the handle.

In one embodiment, the gate latch further includes a first end cap having a central opening placed there through for accepting the linear member, the first end cap for covering the first end of the cylindrical body, and a second end cap having a central opening placed there through for accepting the linear member, the second end cap for covering the second end of the cylindrical body. In a variation of this embodiment, the first and second end caps have female threads and are treaded onto the first and second ends of the cylindrical body.

In a preferred embodiment, the cylindrical body is cut to length to accommodate a specific thickness of the gatepost. In a variation of this embodiment, the linear member is cut to length to facilitate full opening of the latch. In one embodiment, the gate latch of claim 1 is installed on a wooden gatepost. In another embodiment, the gate latch is installed on a metal gatepost.

In one embodiment, the handle is fabricated from glow-in-the-dark plastic. In another embodiment, the handle includes a solar powered light emitting diode (LED) with batteries. In a variation of this embodiment, the solar power apparatus is contained in a cap fitted atop the gatepost. In another embodiment the handle is coated with a glow in the dark coating. In one embodiment, the gate latch further includes one or more additional linear members of varying but standard lengths. In one embodiment, the clamp used to retain the spring is a spring-loaded alligator type clamp.

BRIEF DESCRIPTION OF THE DRAWING FIGURES

DETAILED DESCRIPTION

The present invention provides a gate latch assembly and latch-operating component that makes operating a gate latch more consistent with less work on the part of the operator. The present invention will be described in enabling detail using the following examples, which may describe more than one relevant embodiment falling within the scope of the present invention.

Figure 2:
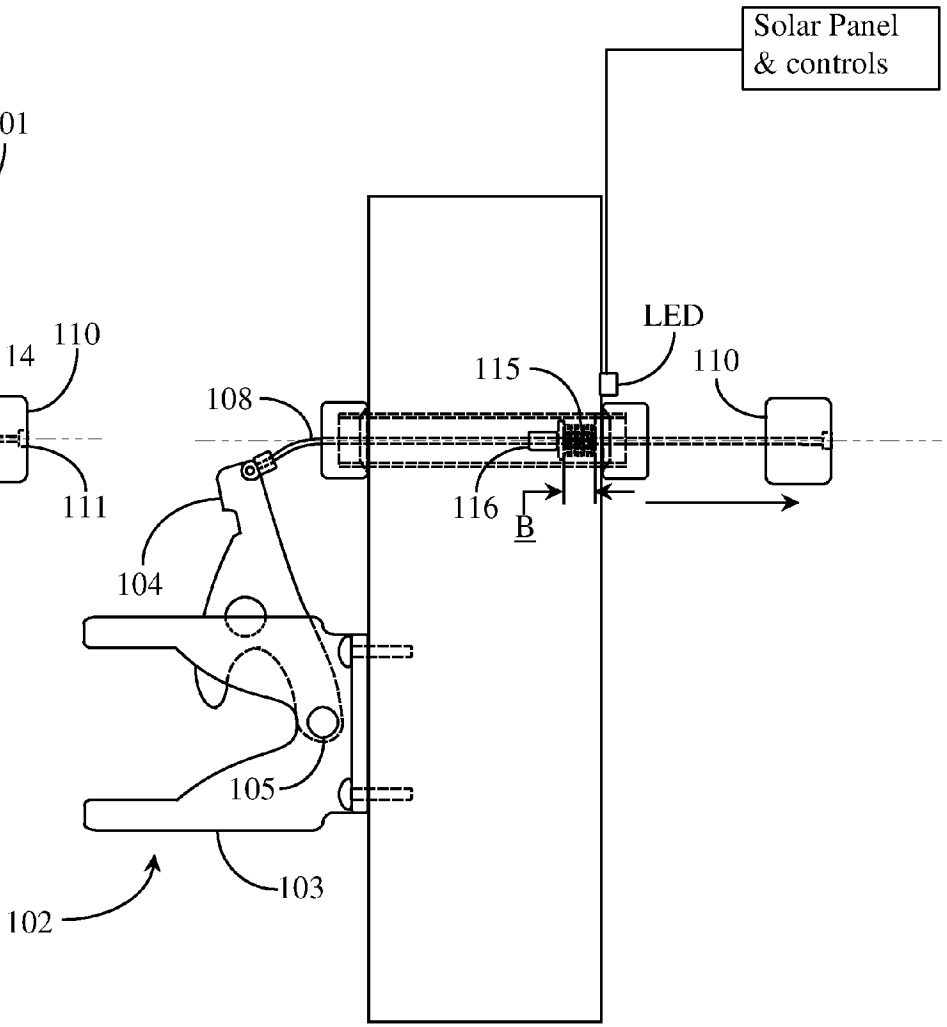
FIG. 2 is an elevation view of the gate latch system of FIG. 1 with the latch in the open position.
Figure 1:
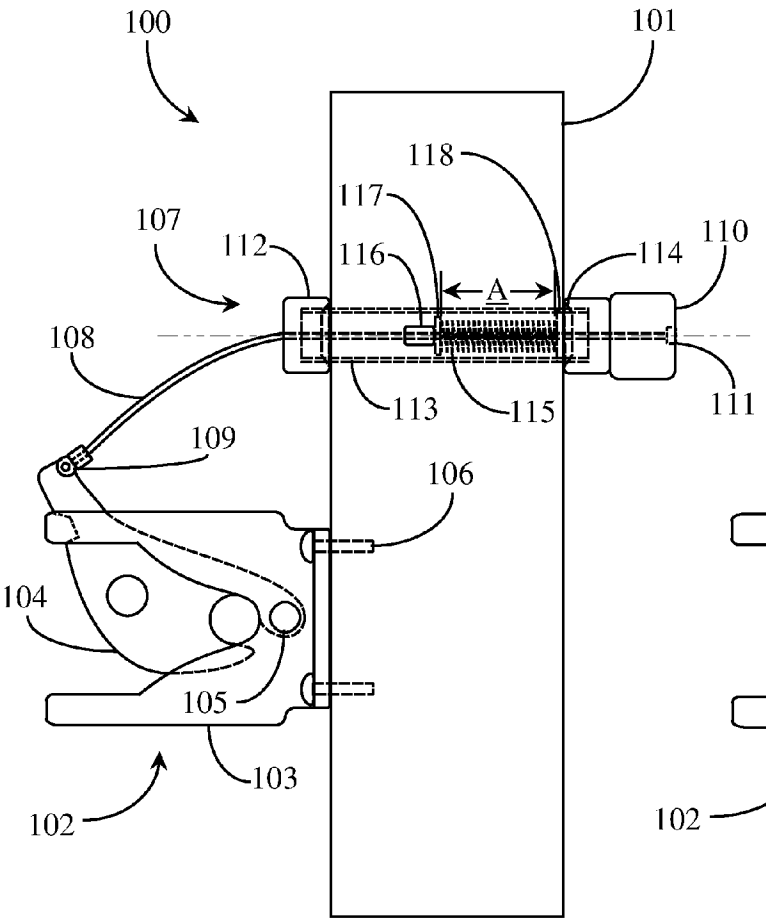
FIG. 1 is an elevation view of a gate latch system according to an embodiment of the present invention in the latch-closed position.

FIG. 1 is an elevation view of a gate latch system 100 according to an embodiment of the present invention in the latch-closed position. FIG. 2 is an elevation view of the gate latch system of FIG. 1 with the latch in the open position. Referring now to FIG. 1, gate latch system 100 includes a modified version of vertical gate latch assembly 102. Gate latch assembly 102 includes a gate latch housing 103 and a gate latch plate 104. Gate latch housing 103 is a piece of sheet metal folded over on itself to form a housing that culminates in a mounting bracket having at least four openings provided there through for mounting purposes. Gate latch housing 103 is installed to the face surface of a gatepost 101 by wood screws 106 in this example. However other fasteners can be used.

Gate latch plate 104 is a piece of sheet metal formed into a latch capable of receiving a latch bar (not illustrated). Latch plate 104 is rotably pinned within gate latch housing 103 using a pin or dowel 105. Dowel 105 is a steel pin in one embodiment. However other rigid materials may be used in the manufacture of pin 105. Gate latch assembly 102 is described as a vertical latch assembly because latch plate 104 assumes a vertical orientation in the assembly and opens and closes along a vertical plane orthogonal to the axis of pin 105.

Gate latch system 100 includes a latch operating assembly 107. Gate latch operating assembly is adapted to be installed through an opening provided by drilling or boring through the interior of gatepost 101 roughly in line with and orthogonal to the vertical gate latch assembly. In a preferred embodiment, gate latch operating assembly includes a cylindrical body such as a tubing or pipe 113. The inside diameter of the through hole placed through gatepost 101 is held just larger that the outside diameter of cylindrical body 113 for a slidable fit.

Cylindrical body 113 has male threading provided at opposing ends to accommodate a first and second flange nut 114. Flange nuts 114 have female threading matching the thread specification of the cylindrical tubing and are threaded over the cylindrical body at opposing ends. A washer may be utilized at either end between the gatepost surface and the flange nut. In a preferred embodiment cylindrical body 113 is provided at such a length that it may be trimmed or cut to length to accommodate different thicknesses of gateposts. In this embodiment, the male threading on each side of the tube may be extended to about the center of the tube from both ends ensuring enough threading for installation of the flange nuts after cutting the tube to the appropriate length for installation.

Cylindrical body 113 is secured in rigid position within gatepost 101 by tightening down the flange nuts 114 over one or more washers until the body is rigidly secure within the post. The body should extend beyond the gatepost surface at both ends to accommodate further components that are attached to the assembly. For example, latch-operating assembly 107 includes a first and second cap 112. Cap 112 has a central opening provided through the back wall for accepting a resilient linear member 108 such as a wire, or plastic zip tie. Cap 112 includes female threading about the inside surface thereof that is of sufficient depth to enable the cap to be threaded over the exposed end of cylindrical body 113 and over the flange nut hiding the flange nut from view. Cylindrical body 113 and caps 112 are fabricated of a polymer such as Polyvinyl Chloride (PVC) or some other whether and sun (UV) resistant material. Cylindrical body 113 and caps 112 could also be fabricated from any kind of metal such as brass, stainless steel etc. . . .

Latch operating assembly 107 includes a handle 110. Handle 110 may be molded of plastic or may be assembled (glued) from PVC components such as a short tube and opposing caps. Handle 110 may be hollow inside or it may be a solid piece of plastic. Handle 110 has an opening provided there through substantially in line with the longitudinal axis of tube 113. The opening is sufficiently large to accommodate threading through of resilient linear member 108.

Second cap 112 is threaded over tube 113 and flange nut 114 on the side of gatepost 101 opposite the latch side of the assembly. Linear member 108 is a zip tie, in one embodiment, consisting of a linear member capable of slidably locking to a zip tie receptacle such as the standard receptacle found at one end of a typical zip tie. The use of a zip tie in this example does not represent a limitation of the present invention as other types of linear members such as a string, cord, or wire might be used instead without departing from the spirit and scope of the present invention. The use of a zip tie in this example presents an opportunity to trim or cut the tie to a length suitable for fully closing and opening the latch plate in the latch assembly and an opportunity for a quick connection to the latch plate after trimming. Linear member 108 can be connected to latch 104 in any number of ways without departing from the scope of the invention.

In this example, linear member 108 is physically inserted through latch operating assembly 107 from the end supporting handle 110. In an embodiment where the linear member is a zip tie, a zip tie seat or stop seat 111 is provided as a counter bore feature at the opening on handle facing away from the assembly. In another embodiment, linear member 108 may be fastened to handles 110 in some other fashion. Linear member 108 extends through the center of cylindrical body 113 and extends out from the assembly toward the latch plate of the gate latch assembly 102.

Latch operating assembly 107 includes a steel spring 115. Spring 115 is disposed over linear member 108. Spring 115 may be a straight spring or a tapered spring without departing from the spirit and scope of the present invention. Spring 115 has an outside diameter that is smaller than the inside diameter of tubing 113 so that it may be retained within cylindrical body 113. Spring 115 is retained within cylindrical body 113 using at least two washers 117 and 118, the washers disposed over linear member 108 and on opposite sides of spring 115. In one embodiment washer 118 is seated within tubing 113 to retain one end of spring 115. In another embodiment tube 113 has a shoulder at one end to retain spring 115. It will be apparent to the skilled artisan, given the descriptions and figures, that, in the absence of a special retainer for spring 115, the spring will be adequately retained by cap 112. A stop clamp 116 having an internal opening slightly larger than the outside dimensioning of linear member 108 is provided to station spring 115 in a relaxed sate on linear member 108. Clamp 116 is pressed down over linear member 108 after it is inserted onto linear member 108 and slid into position before clamping it in place to retain spring 115 in position. In one embodiment, a butterfly clamp or some other clamping device such as a spring loaded alligator type clamp might be used instead of clamp stop 116.

The free end of linear member 108 is trimmed if required before attaching it to latch plate 104 on latch assembly 102. An opening is provided at the top end of latch plate 104 to facilitate an interface for attachment of the linear member. In this case, a plastic zip tie seat 109 comprising a plastic tube formed with an orthogonal zip tie receptacle is attached to latch plate 104. In this configuration, zip tie 108 may be trimmed to length if required, and then inserted into the receptacle of seat 109 to secure the zip tie to the latch plate. Other methods of attachment are also possible depending upon the nature of linear member 108, however, the method of attachment depicted herein affords the ability to trim and reattach if needed.

Spring 115 is illustrated in a substantially decompressed or relaxed state in FIG. 1 taking up a length A within cylindrical body 113. The length of A shall be sufficient to force latch plate 104 into a closed position owing to the resilient nature of linear member 108. Referring now to FIG. 2, handle 110 is depicted as pulled out from the gatepost in an act of opening the latch. When handle 110 is pulled out, spring 115 within cylindrical body 113, compresses due to the movement of the linear member and the retained position of the spring within body 113. Latch plate 104 is pulled up to near maximum height; at least enough to free a latch bar and open the gate. Latch operating assembly 107 may be easily disassembled requiring only a wrench to loosen the flange nuts. A user may replace or readjust the linear member when required. The compression force of spring 115 may also be easily readjusted by taking the assembly apart performing the adjustment and reassembling the cylindrical body. The linear member may be detached from latch plate 104 by removing the pin through seat 109 or by snipping the linear member at the latch plate. Washers 117 and 118 are metal washers in this example however; plastic washers may also be used instead.

In one embodiment, handle 110 is made from glow-in-the-dark plastic or painted with a glow-in-the-dark paint so that a user may readily see the door handle at night or in low light conditions. In one embodiment, a solar powered LED with a mini solar collector, may be provided on handle 110 or in close proximity on the gatepost so that the handle is lit up when the sun goes down. Such as solar power source may include a voltaic solar cell or panel installed on top of the gatepost such as in a special vinyl post cap housing a pair of rechargeable batteries and battery charging circuitry. Handle 110 could also have its own mini solar collector and battery contained within the handle 110 itself. Solar solutions above could also be applied to element 112.

Figure 3:
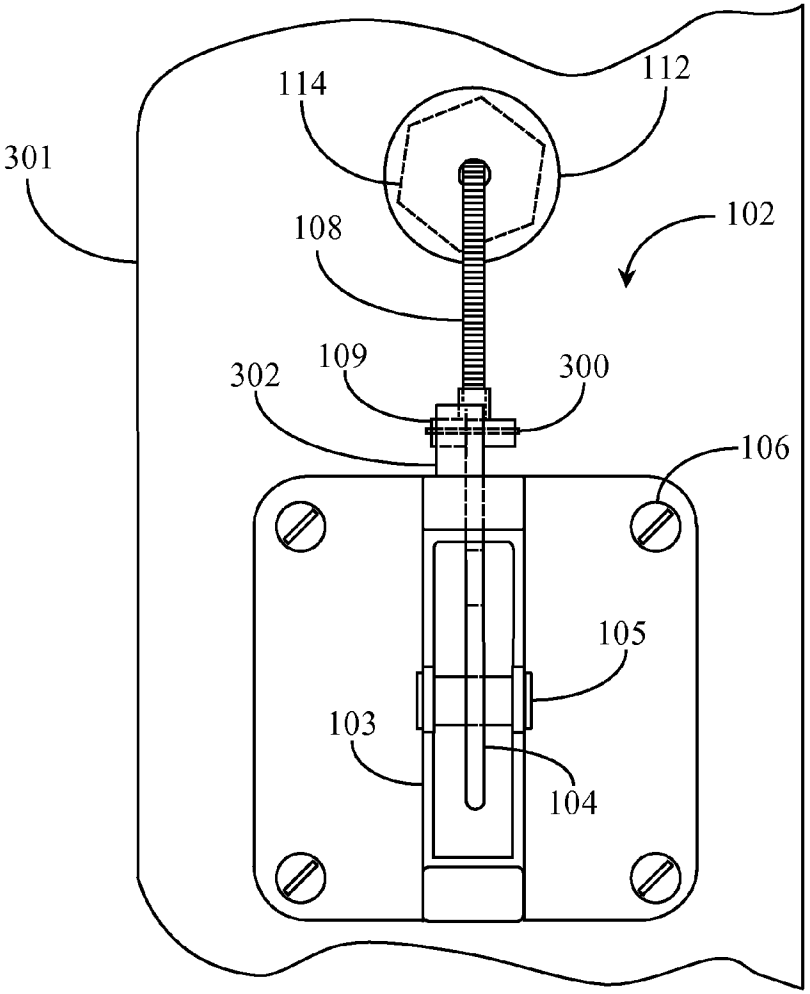
FIG. 3 is a front partial view of the vertical latch assembly of FIG. 1 connected to the latch operating assembly of FIG. 1.

FIG. 3 is a front partial view of the vertical latch assembly of FIG. 1 connected to the latch operating assembly of FIG. 1. In this front view, latch assembly 102 can be better visualized. Latch assembly 102 is mounted vertically onto the surface of a gatepost by screws 106. Latch plate 104 rotates about pin 105. In this example, latch plate 104 includes an offset thumb flap 302 formed thereon for facilitating easy manual lifting of the latch plate in the assembly. Receptacle 109 is pinned onto latch plate 104 using the provided opening and a steel dowel 300.

Linear member 108, in this case, a zip tie, is inserted into a zip tie receptacle on seat 109. The receptacle enables insertion and lock of the linear member into the receptacle. The only visible part of the latch operating assembly from this side of gatepost 301 is cap 112. Cap 112 is threaded over the cylindrical body on top of and covering flange nut 114 visible in broken boundary beneath the cap in this view. It should be noted herein that there may be a counter bore relief at both end of the hole drilled through the gatepost so that the depth and diameter of the counter bore encompasses the flange nut. In one embodiment the cap contains bell feature that covers the flange nut to the wood of the gatepost while both the flange nut and cap are threaded onto the same end of the tube.

Figure 4A:
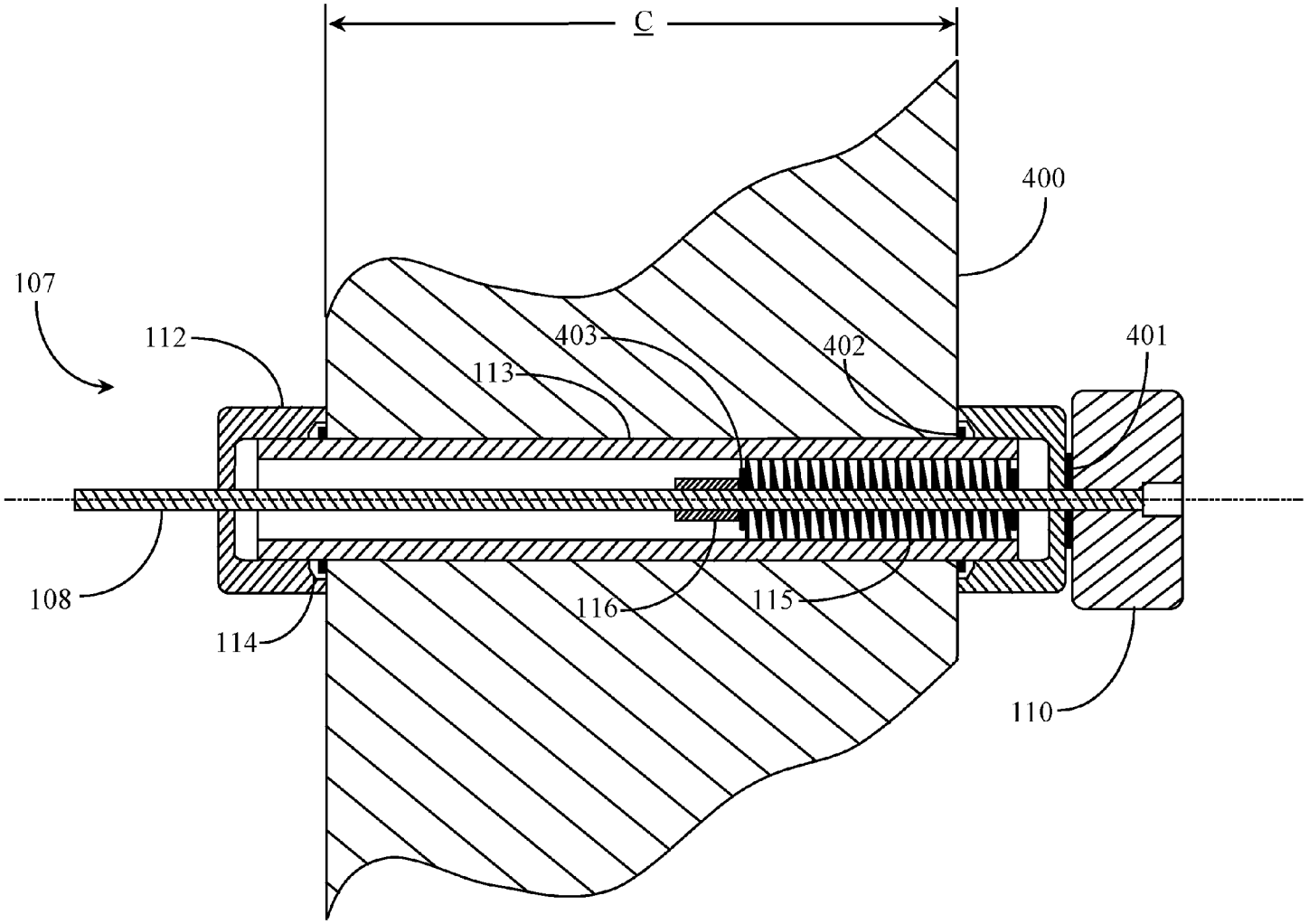
FIG. 4 is a sectioned and exploded view of the latch operating assembly of FIG. 1
Figure 4B:
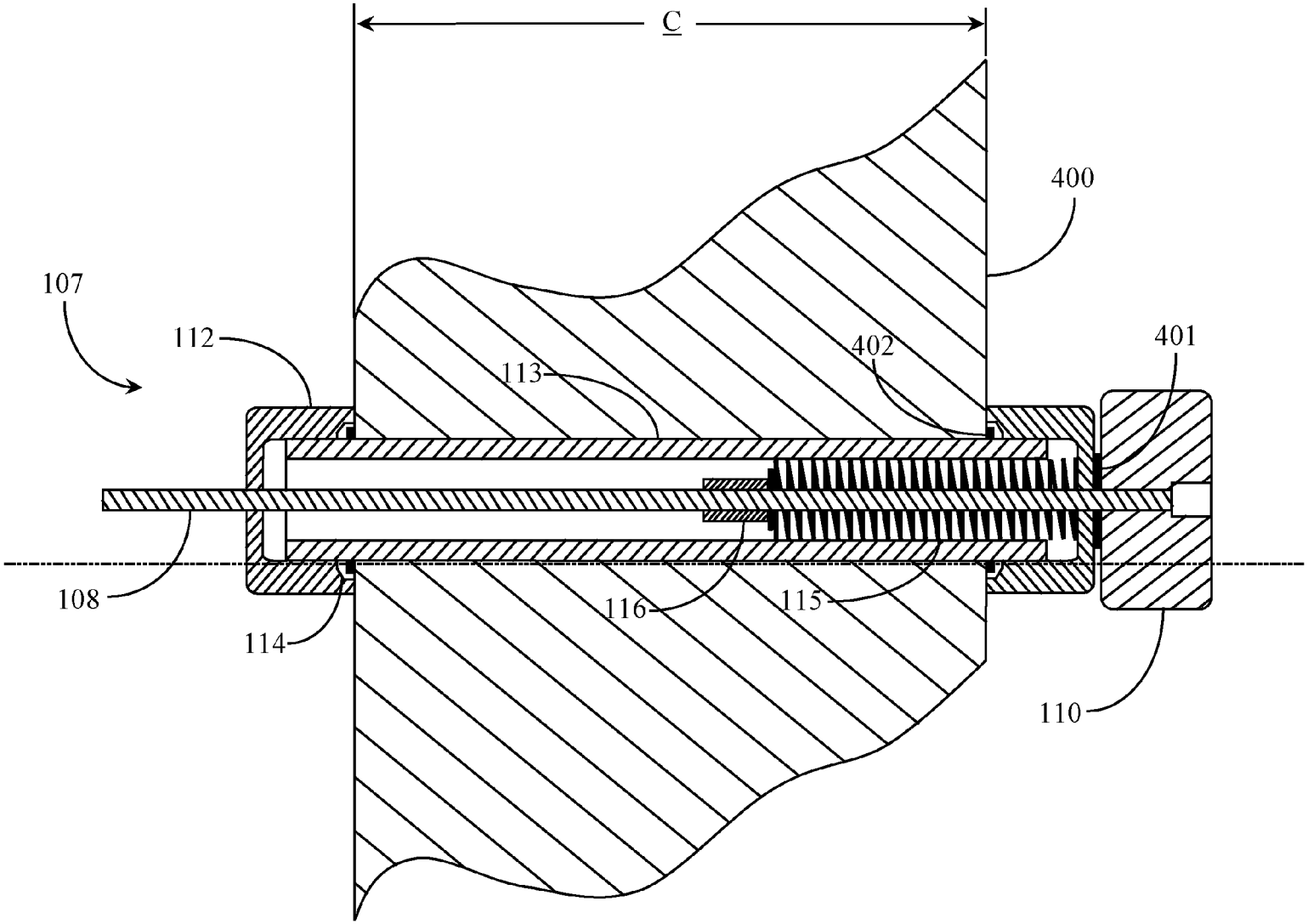

FIG. 4*a* is a sectioned and exploded view of the latch operating assembly of FIG. 1. The latch operating assembly is installed in a gatepost 400. In this case, gatepost 400 has an overall thickness of C representing a larger post than previously illustrated. Post 400 may be a 6×8 or an 8×8 gatepost. Cylindrical body 113 can be cut to length to accommodate all standard gateposts. In this example, a rubber washer 401 is placed between handle 110 and cap 112. Caps 112 are threaded onto body 113 over flange nuts 114 as described further above. In this example, rubber washers 402 are placed one each beneath the flange nuts against the wood surface of gatepost 400. In one embodiment, cylindrical body 113 may be installed through a metal or plastic gatepost that is solid or substantially hollow. Flange nuts 114 secure the latch operating assembly in place regardless of the post material. FIG. 4*b* shows the assembly of the latch operating assembly with no special retainer for spring 115, so the spring rests against the closed end of cap 112.

In one embodiment of the invention, handle 110 may also be a cap and may be threaded, in one embodiment, over cap 112 when not in use to prevent inadvertent opening of the gate. In another embodiment, a screw may be provided to secure handle 110 to cap 112 when not in use to prevent unintended opening of the gate. In still another embodiment, a wire lock may be routed through both handle 110 and cap 112 and then closed to lock when not in use. A key may be required to unlock the handle from the cap so regular use may continue. When a user pulls out the handle against spring tension the latch plate lifts up to release the latch bar. When the user closes the gate, the user maintains the pullout state of the handle keeping the latch plate open until the gate is closed and the latch bar is seated in the latch assembly. As the user lets go of the handle with the gate closed, the Latch plate is gently forced down over the latch bar effectively locking the gate. The force-down of the latch plate is in part due to the resiliency of the linear member.

In one embodiment of the present invention, the latch-operating assembly includes a spacer component in the form of a spacer ring with a slot cut through the cylinder wall and breaking out at both ends. This enables the spacer ring to be positioned over the linear member and between the handle and the cap when the handle is pulled out against the spring pressure. In this case, spring tension holds the spacer in place and the gate latch stays in the open position for times or events when a lot of traffic will go back and forth through the gate. There are many possibilities.

Figure 5:
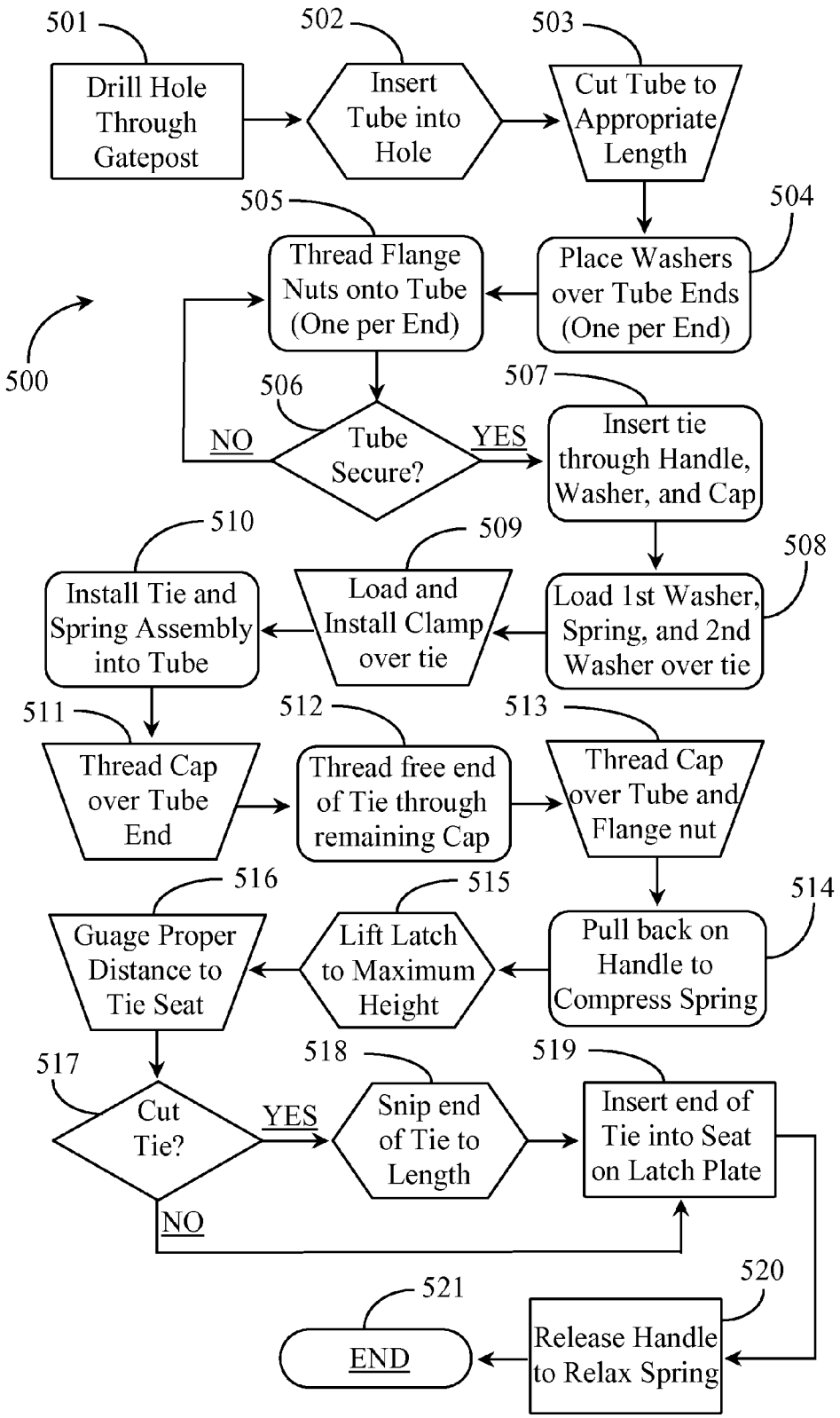
FIG. 5 is a process flow chart depicting steps for installing the gate latch system according to an embodiment of the present invention.

FIG. 5 is a process flow chart 500 depicting steps for installing the gate latch system according to an embodiment of the present invention. In this aspect of the process, it is assumed that the latch assembly, including the seat for the linear member, and latch bar plate are already installed and working properly before beginning installation of the latch operating assembly. At step 501, a user drills a hole through the gatepost at a position above and orthogonal to the vertical latch assembly installed on the opposite face of the gatepost as depicted in FIG. 3. The drill size may vary according to the scale of the apparatus. For example, the cylindrical body may have a larger diameter and come with a stronger spring for more robust installations on larger gateposts or for metal gateposts. Alternatively, the diameter of the cylindrical body may be smaller and housing a smaller spring for light post/gate installations.

The user inserts the cylindrical tube into and through the hole at step 502. In this step, a user may visually determine if the tube should be cut to accommodate the thickness of the gatepost. Assuming that the tube will be cut to length during installation, the user cuts the tube to length at step 503. The tube may be cut with a suitable PVC pipe cutter or like instrument. At step 504, the user may place washers, one per each end, over the inserted tube. The washers may be rubber washers, plastic washers, or washers made from some other material suitable for cushioning washers. It is noted herein that a properly cut and inserted tube will have substantially equal lengths thereof protruding past both surfaces of the gatepost.

At step 505, the user may install flange nuts, one over each end, threading the nuts down to the surface of the gatepost at both ends to secure the installation. In one embodiment the flange nuts may seat at the bottom of counter bores placed in the openings so that they recede past the surface of the gatepost in the installation. However, this is not required to practice the present invention. At step 506, the user determines if the installation is rigid and secure. If at step 506 the user determines that the installation is not secure, the process resolves back to step 505 until the flange nuts are adequately tightened against the face of the gatepost.

At step 505, if the user determines that the installation is secure, then the user inserts the linear member, such as a zip tie strip through the handle, the washer (between cap and handle), and the cap at step 507. At step 508, the user loads the first retaining washer, the spring, and the second retaining washer onto the linear member. The first retaining washer may abut against the flange nut. At step 509, the user loads the clamp over or on the linear member at a position so as to abut against the second washer and spring, but without unduly compressing the spring. The clamp may be pressed or collapsed over the linear member or some other clamping technique might be observed.

At step 510 users install the linear member or tie and spring assembly into the cylindrical body or tube. A step 511, the user threads the cap over the tube end down to cover the flange nut. At step 512, the user threads the free end of the linear member or tie through the remaining cap at the opposite end. At step 513, the user threads the remaining cap over the remaining tube end down to the flange nut to cover the flange nut. At this point the installation of the operating assembly is complete accept for the connection to the latch plate.

At step 514, the user may pull back on the handle against spring compression and at step 515 the user may lift the latch plate to the top position or maximum height in order to gauge the proper distance of tie to the seat on the latch plate. With the handle pulled back and the latch plate pulled up, the user gauges the distance required to properly attach the linear member to the latch plate at step 516. At step 517, the user makes a determination whether to cut the linear member before attaching it to the latch plate.

If the user determines to cut the linear member to a more appropriate length at step 517, the user snips the linear member to the proper length at step 518. In one embodiment, there may be more than one linear member provided of different lengths that are applicable to certain installations and post sizes. In such a case, the user may simply choose the correct length from a pool of linear members. If the user determines not to cut the linear member, then the process skips step 518 and moves to step 519. At step 519 the user inserts the free end of the linear member into the seat connected to the latch plate. In the case of a zip tie, the user only need insert the tie end to engage the teeth on the seat to lock the member in place.

At step 520, the user then releases the handle to relax the spring, which in turn urges the latch plate into the closed position. The process then ends for installation at step 521. The user may now pull and release the handle to open and close the latch plate required to open and close the gate.

It will be apparent to one with skill in the art that the gate latch system of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

What is claimed is:

1. A gate latch release assembly, comprising:

a tubular guide having a guide length, a longitudinal guide axis, an inside guide diameter and a concentric outside guide diameter, the tubular guide having male threading on the outside diameter extending the full guide length;

a first and a second cylindrical cap element, each cap element having a cap axis, an outside cap diameter greater than the outside guide diameter, a cap length substantially less than the guide length, a female-threaded cap bore on a cap axis extending from a first end along a portion of the cap length, the female threading in the cap bore compatible with the male threading of the tubular guide, and a closed end having a cap opening on the cap axis, with the cap opening having a diameter substantially less than that of the female threaded cap bore, the first cap element threaded onto a first end of the tubular guide, and the second cap element threaded onto a second end of the tubular guide opposite to the first end;

a flexible cord, wire, cable or plastic line having a first and a second end, a length substantially longer than the guide length, and a diameter smaller than that of the cap opening, the flexible cord, wire, cable or plastic line passing through the cap openings of the two cap elements and the tubular guide such that the first end extends out of the first cap element and the second end extends out of the second cap element;

a compression spring having a first and a second spring end, a spring length less than the guide length and a spring outside diameter less than the inside guide diameter, the compression spring positioned within the tubular guide around the portion of the flexible cord, wire, cable or plastic line within the tubular guide such that the first spring end bears on the closed end of the first cap element;

a handle element having a size too great to pass through the cap opening of the first cap element, the handle element affixed to the cord, wire, cable or plastic line at the first end; and a spring-retainer element affixed to the cord, wire, cable or plastic line within the tubular guide at a point at the second spring end, partially compressing the spring against the closed end of the first cap element;

wherein, with the tubular guide held stationary, pulling the handle element away from the first cap element further compresses the compression spring, and shortens the length of the cord, wire, cable or plastic line extending from the second cap element, and allowing the compressed spring to move the handle element back towards the first cap element such that the length of the cord, wire, cable or plastic line extending from the second cap element is increased.

2. The gate latch release assembly of claim 1 wherein the tubular guide is cut to a length to accommodate a thickness of a specific gate post, and the gate latch release assembly is assembled through a hole bored through the specific gate post, with the tubular guide secured through the hole by the first and the second cap elements tightened against the gate post.

3. The gate latch release assembly of claim 1 further comprising a first rubber washer between the first cap element and the gate post on one side and a second rubber washer between the second cap element and the gate post on the opposite side.

4. The gate latch release assembly of claim 1 wherein the second end of cord, wire, cable or plastic line extending from the second cap element is fastened to a gravity-operated latch plate of a latch assembly, such that pulling on the handle element raises the gravity-operated latch plate, releasing the latch.

5. The gate latch release assembly of claim 1, wherein the handle element is fabricated from glow-in-the-dark plastic.

6. The gate latch release assembly of claim 1, further comprising at least one light emitting diode (LED).

7. The gate latch release assembly of claim 6 further comprising a solar panel and operating elements to power the LED.

* * * * *